US009416513B2

(12) United States Patent
Kemp et al.

(10) Patent No.: US 9,416,513 B2
(45) Date of Patent: Aug. 16, 2016

(54) HELICAL SCREW PILE AND SOIL DISPLACEMENT DEVICE WITH CURVED BLADES

(71) Applicant: Hubbell Incorporated, Shelton, CT (US)

(72) Inventors: Timothy Michael Kemp, Columbia, MO (US); Shawn David Downey, Columbia, MO (US); Kelly Suzanne Hawkins, Centralia, MO (US)

(73) Assignee: Hubbell Incorporated, Shelton, CT (US)

( * ) Notice: Subject to any disclaimer, the term of this patent is extended or adjusted under 35 U.S.C. 154(b) by 133 days.

(21) Appl. No.: 14/063,107

(22) Filed: Oct. 25, 2013

(65) Prior Publication Data

US 2015/0117960 A1 Apr. 30, 2015

(51) Int. Cl.

| | |
|---|---|
| ***E02D 5/56*** | (2006.01) |
| ***E02D 5/80*** | (2006.01) |
| ***E02D 5/72*** | (2006.01) |
| ***E21B 7/26*** | (2006.01) |
| ***E21B 10/42*** | (2006.01) |

(52) U.S. Cl.

CPC .. *E02D 5/56* (2013.01); *E02D 5/72* (2013.01); *E02D 5/801* (2013.01); *E21B 7/26* (2013.01); *E21B 10/42* (2013.01)

(58) Field of Classification Search

USPC ..... 405/252.1, 253, 255

See application file for complete search history.

(56) References Cited

U.S. PATENT DOCUMENTS

| | | | | |
|---|---|---|---|---|
| 4,623,025 | A | 11/1986 | Verstraeten | |
| 5,252,009 | A * | 10/1993 | Bossler | 408/145 |
| 5,707,180 | A | 1/1998 | Vickars et al. | |
| 6,082,472 | A | 7/2000 | Verstraeten | |
| 6,264,402 | B1 | 7/2001 | Vickars et al. | |
| 6,834,733 | B1 * | 12/2004 | Maouche et al. | 175/378 |
| 7,040,842 | B2 | 5/2006 | Stotzer | |
| 7,241,079 | B2 | 7/2007 | Francis | |
| 7,494,299 | B1 | 2/2009 | Whitsett | |
| 7,571,781 | B2 * | 8/2009 | Stoetzer | 175/413 |
| 8,033,757 | B2 | 10/2011 | Stroyer | |
| 2013/0101360 | A1 | 4/2013 | Lutenegger et al. | |
| 2013/0343823 | A1 * | 12/2013 | Lin | 405/233 |

FOREIGN PATENT DOCUMENTS

| | | | |
|---|---|---|---|
| DE | 3314125 | A1 | 10/1984 |
| JP | 2001040662 | A | 2/2001 |
| JP | 2010222853 | A | 10/2010 |
| JP | 2012077537 | A | 4/2012 |

* cited by examiner

*Primary Examiner* — Benjamin Fiorello
*Assistant Examiner* — Kyle Armstrong
(74) *Attorney, Agent, or Firm* — Dickinson Wright PLLC

(57) ABSTRACT

A helical screw pile having a soil displacement device (lead displacement plate) on its shaft above at least one helical plate, which pulls the pile into the ground when the shaft is rotated. The lead displacement plate has a disk that carries at least two curved, axially extending bottom blades, which preferably extend beyond the disk periphery. The axial height of the blades preferably is greater than the axial pitch of the helical plate(s) divided by the number of blades. The top of the disk has an axially extending adapter ring that defines an annular seat for centering a tubular casing. Extension displacement plates can be used between extension shafts for centering additional tubular casings.

16 Claims, 3 Drawing Sheets

HELICAL SCREW PILE AND SOIL DISPLACEMENT DEVICE WITH CURVED BLADES

FIELD OF THE INVENTION

The invention relates to foundation systems, in particular, helical pile foundation systems, which use a screw to pull a shaft and a soil displacement device through the ground.

BACKGROUND OF THE INVENTION

Piles are used to support structures where surface soil is weak by penetrating the ground to a depth where a competent load-bearing stratum is found. Helical (screw) piles represent a cost-effective alternative to conventional piles because of their speed and ease of installation and relatively low cost. They have an added advantage with regard to their efficiency and reliability for underpinning and repair. A helical pile typically is made of relatively small galvanized steel shafts sequentially joined together, with a lead section having helical plates. The pile is installed by applying torque to the shaft at the pile head, which causes the plates to screw into the ground with minimal soil disruption.

The main drawbacks of helical piles are poor resistance to both buckling and lateral movement. Greater pile stability can be achieved by incorporating a portland-cement-based grout column around the pile shaft. See, for example, U.S. Pat. No. 6,264,402 to Vickars (incorporated by reference herein in its entirety), which discloses both cased and uncased grouted screw piles and methods for installing them. The grout column is formed by creating a void in the ground as the shaft descends and pouring or pumping a flowable grout into the void to surround and encapsulate the shaft. The void is formed by a soil displacement disk attached to the shaft above the helical plate(s). The grout column may be reinforced with lengths of steel rebar and/or polypropylene fibers. A strengthening casing or sleeve (steel or PVC pipe) can also contain the grout column. However, because the casing segments are rotated as the screw and the shaft advance through the soil, substantial torque and energy are required to overcome frictional forces generated by contact with the surrounding soil. More effective compaction of the surrounding soil would reduce skin friction during installation and lessen damage to the casing.

SUMMARY OF THE INVENTION

One aspect of the invention is a soil displacement device for penetrating and forming a void in the ground when rotated about a central longitudinal axis by a helix-bearing shaft. The device comprises a disk having a periphery, a top, a bottom and a central opening for receiving a shaft. At least two blades are disposed below the top of the disk. Each blade projects substantially axially from the bottom of the disk to a free distal end and curves outward from near the opening to at least the periphery of the disk. The blades preferably extend beyond the disk periphery, and the radius of curvature of each blade preferably is non-uniform. Each blade preferably tapers toward its distal end, and the bottom of the disk preferably tapers toward its periphery. The top of the disk may carry an axially extending adapter ring that defines an annular seat on the disk for centering a tubular casing.

Another aspect of the invention is a helical screw pile for penetrating the ground and forming a support. The screw pile comprises a shaft having a longitudinal axis and a bottom end, at least one helical plate on the shaft near the bottom end and a soil displacement device, as described above, on the shaft above the helical plate. Each blade of the soil displacement device preferably has an axial height that is greater than the axial pitch of the helical plate(s) divided by the number of blades. The shaft may comprise sequentially connected segments including a lead shaft and extension shafts, the lead shaft carrying at least the helical plate(s). The soil displacement device is carried by either the lead shaft or one of the extension shafts, and an extension displacement plate may be located above the soil displacement device, the extension displacement plate having oppositely facing annular seats for centering tubular casings surrounding the extension shafts.

BRIEF DESCRIPTION OF THE DRAWING

Embodiments of the disclosed invention, which include the best mode for carrying out the invention, are described in detail below, purely by way of example, with reference to the accompanying drawing, in which.

DETAILED DESCRIPTION OF THE INVENTION

Figure 1:
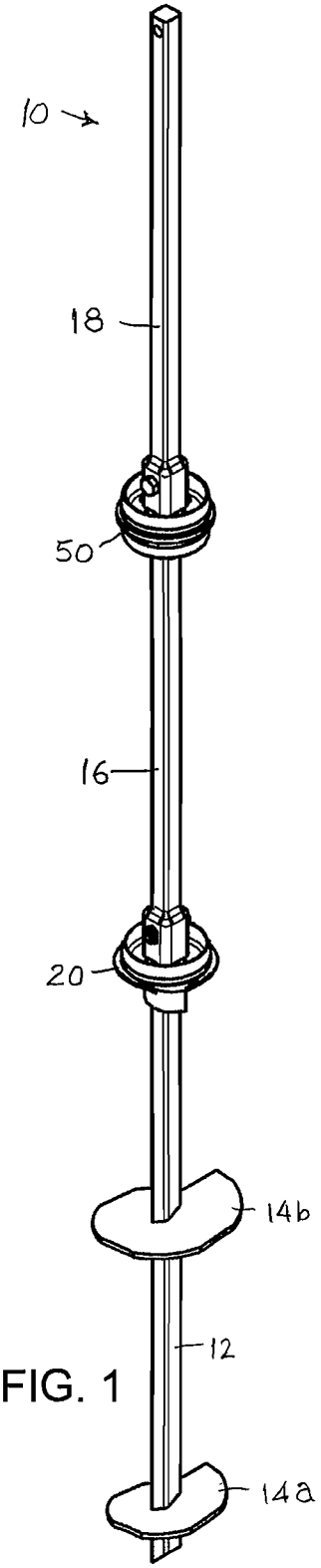
FIG. 1 is a perspective view of an assembled helical pile according to the invention shown without a surrounding grout column or casing.
Figure 3:
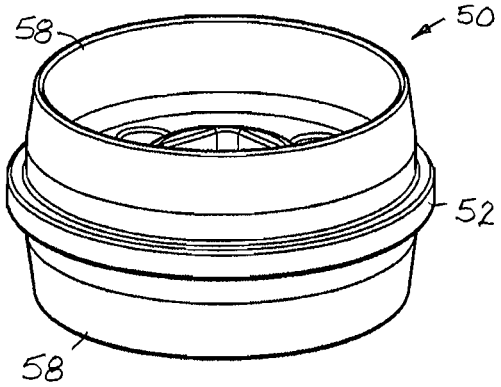
FIG. 3 is a perspective view of an extension displacement plate according to the invention used in the pile of FIG. 1.
Figure 2:
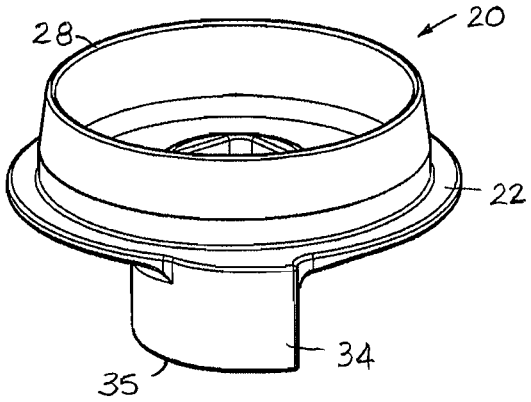
FIG. 2 is a perspective view of a soil displacement device according to the invention used in the pile of FIG. 1.
Figure 4:
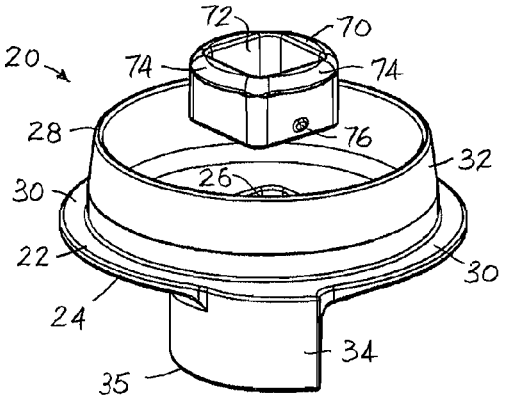
FIG. 4 is an exploded perspective view of the soil displacement device of FIG. 2 shown with an optional insert.
Figure 5:
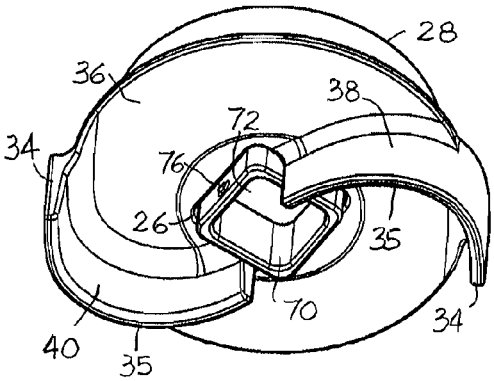
FIG. 5 is a bottom perspective view of the soil displacement device and insert of FIG. 4 assembled together.
Figure 6:
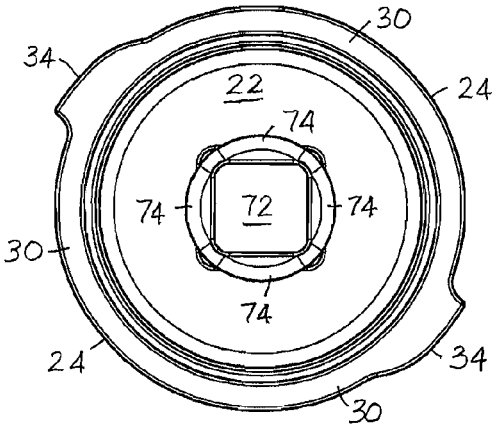
FIG. 6 is a top plan view of the assembly of FIG. 5.

Referring to FIG. 1, a helical pile according to the invention has a central screw pier 10 comprising a series of conventional steel shaft sections with mating male and female ends that are bolted together sequentially as the pile is installed, in a manner well known in the art. The shaft cross-section preferably is square, but any polygonal cross-section, a round cross-section or a combination of cross-sections may be used. The bottom three shaft sections are shown in FIG. 1, it being understood that additional shaft sections can be installed above those shown in like manner until a competent load-bearing stratum is reached.

A conventional lead shaft 12 at the lower end of the pile carries helical plates 14*a*, 14*b* that advance through the soil when rotated, pulling the pile downward. In the illustrated example, the soil displacement device (lead displacement plate) 20 is attached to lead shaft 12 above helical plate 14*b* together with a first extension shaft 16. A second extension shaft 18 is joined to first extension shaft 16 with an interposed extension displacement plate 50, and so on with additional extension shafts and extension displacement plates 50 to the top of the pile. Lead displacement plate 20 preferably is located at a position such that it will encounter and ultimately come to rest in or near relatively loose soil. Thus, depending on the soil conditions in the various strata, lead displacement plate 20 could be carried by one of the extension shafts 16, 18, etc. instead of by lead shaft 12. Furthermore, additional lead displacement plates 20 could be used instead of extension displacement plates 50 along all or part of the length of the pile.

Figure 7:
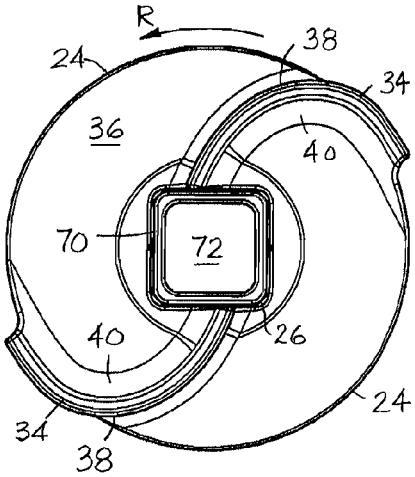
FIG. 7 is a bottom plan view of the assembly of FIG. 5.
Figure 8:
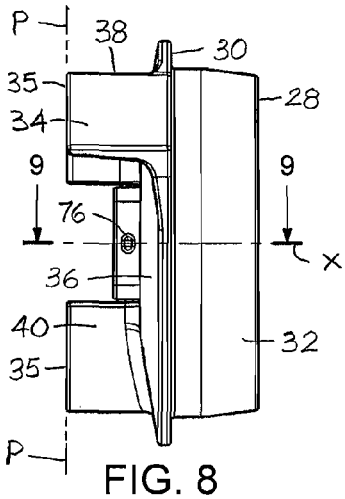
FIG. 8 is right side view of the assembly of FIG. 7.
Figure 9:
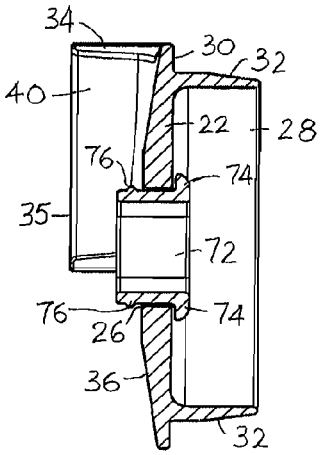
FIG. 9 is a sectional view taken along line 9-9 in FIG. 8.
Figure 10:
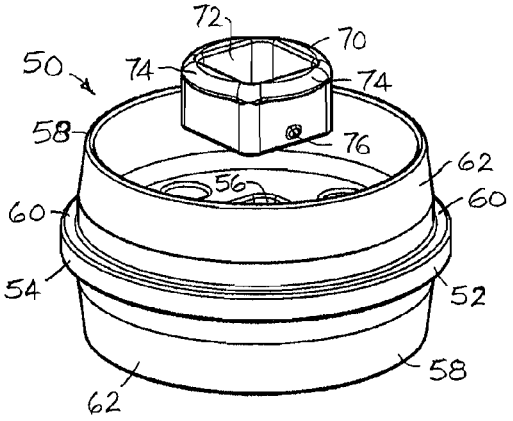
FIG. 10 is an exploded perspective view of the extension displacement plate of FIG. 3 shown with an optional insert.
Figure 11:
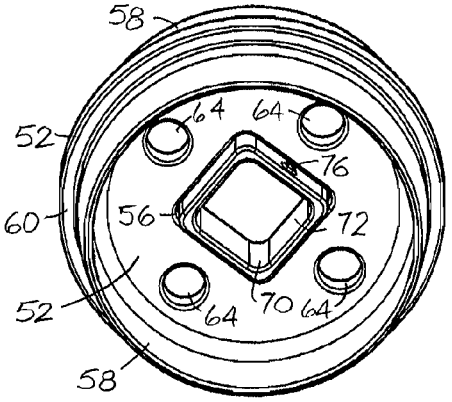
FIG. 11 is a bottom perspective view of the extension displacement plate and insert of FIG. 10 assembled together.
Figure 12:
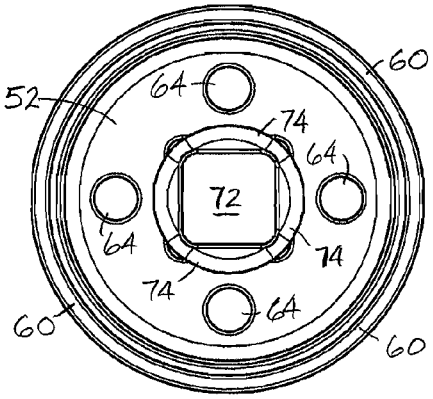
FIG. 12 is a top plan view of the assembly of FIG. 11.
Figure 13:
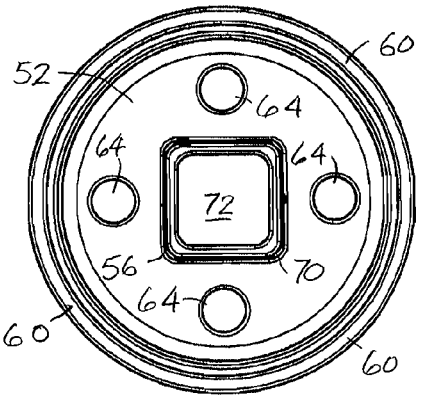
FIG. 13 is a bottom plan view of the assembly of FIG. 11.

Referring to FIGS. 4-9, lead displacement plate 20 is made of steel and comprises a disk 22 having a circular periphery 24 and a square central through-opening 26 for receiving a close-fitting shaft or, optionally, a close-fitting insert 70, which has a smaller square through-opening 72 for receiving a smaller shaft. An integral adapter ring 28 extends axially from the top of disk 22 inboard of the disk periphery 24, thus defining an annular seat 30 for centering an optional tubular casing (used for forming a cased pile), which fits over the adapter ring. As seen in FIGS. 8 and 9, the distal portion of the outer face 32 of adapter ring 28 is tapered to facilitate mating with a range of casing sizes.

Two integral, identical, curved blades 34 project axially from the bottom 36 of disk 22 to their free distal edges 35. The blades are symmetrically positioned about the central axis of the disk, 180° apart. The disk may be provided with a greater number of blades, and all should be identical and symmetrically positioned about the central axis. As best seen in FIG. 8, the distal edges 35 of the blades are substantially coplanar and substantially normal to the disk's central axis X. To minimize soil-to-disk friction from downward installation forces, the axial height of the blades should be greater than the axial pitch of the helical plate(s) divided by the number of blades. The curvature of the blades increases the strength of the disk and reduces the jerk observed with straight-bladed disks during installation through soil transitions and impurities.

Each blade 34 has a leading (convex) face 38 and a trailing (concave) face 40. As best seen in FIGS. 7 and 8, the leading faces 38 are substantially parallel to the disk's central axis X. As viewed in FIG. 7, the direction of rotation R of the lead displacement plate is counterclockwise whereby the leading blade faces 38 push soil outward. Each blade preferably is tapered on its trailing (concave) face 40 (see FIGS. 5, 7 and 9), which facilitates manufacture and locates more material at and near the blade root, where higher reaction forces are required. As best seen in FIG. 7, the curvature of each blade preferably is non-uniform; specifically, the blade's radius of curvature preferably is larger near the central opening 26 and near the disk's periphery 24 than its radius of curvature in the intermediate portion. The blades preferably extend beyond the disk's periphery 24, where a portion of each blade preferably is substantially normal to a radius of the disk, thus tending to smooth the cavity wall as the disk rotates. This arrangement also enhances blade-to-disk strength, adds stability and enhances soil packing to make for a solid cavity wall and reduced friction when installing casing.

Disk 22 is thicker in its central region, its bottom 36 tapering uniformly from near central opening 26 toward its periphery 24 (see FIGS. 8 and 9). The thicker central region enables greater torque transfer from the shaft to the disk and enhances disk stability as it rotates with the shaft (disk stability is important in forming and maintaining a solid cavity wall). As the shaft rotates it moves the disk deeper, so soil is moved from the lower (innermost) blade area to the upper (outermost) portion of the blade and the underside of the disk. The tapered bottom 36 increases soil penetration per normal force unit and allows for shorter blades while displacing the same amount of soil per revolution, reducing installation torque by reducing friction. Reduced installation torque results in increased tension and compression capacity of the installed pile under load.

Figure 14:
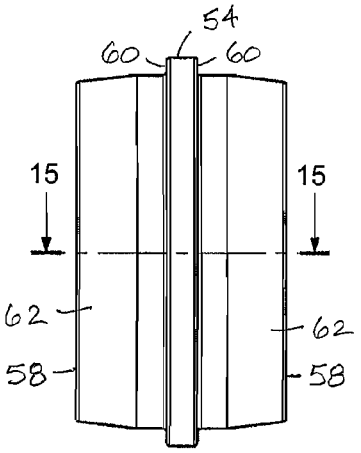
FIG. 14 is a right side view of the assembly of FIG. 13.
Figure 15:
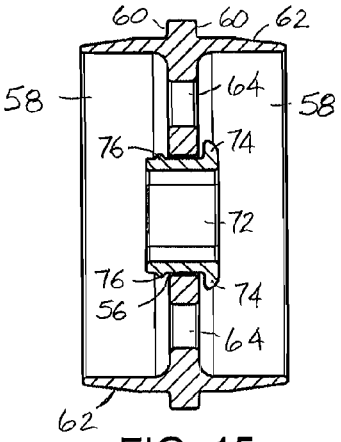
FIG. 15 is a sectional view taken along line 15-15 in FIG. 14.

Referring to FIGS. 10-15, extension displacement plate 50 is made of steel and comprises a central disk 52 having a circular periphery 54 and a square central opening 56 for receiving a close-fitting shaft or, optionally, a close-fitting insert 70, which has a smaller square opening 72 for receiving a smaller shaft. Two integral adapter rings 58 extend axially from the disk 52 in opposite directions inboard of the disk periphery 54, thus defining annular, oppositely facing seats 60 for centering optional tubular casings (used for forming a cased pile), which fit over the adapter rings. As best seen in FIGS. 14 and 15, the distal portion of the outer face 62 of each adapter ring 58 is tapered to facilitate mating with a range of casing sizes. Four holes 64 in the disk allow grout to flow through the disk and fill any voids on the other side.

Inserts allow for different styles of shafts to be used with lead displacement plate 20 and extension displacement plates 50. In the illustrated embodiment, each insert 70 has a square opening 72 for mating with a square shaft. Four lips 74 surround the opening at one end and form disk-engaging shoulders. Nubs 76, one on each of two opposite sides of the insert near its other end, retain the insert in position after it is forced into a central disk opening 26 or 56.

While preferred embodiments have been chosen to illustrate the invention, it will be understood by those skilled in the art that various changes and modifications may be made without departing from the scope of the invention as defined by the appended claims.

What is claimed is:

1. A soil displacement device for penetrating and forming a void in the ground when rotated about a central longitudinal axis by a helix-bearing shaft, the device comprising:

a disk having a periphery, a top, a bottom and a central through-opening for receiving a shaft; and at least two blades disposed substantially completely below the top of the disk, each blade projecting substantially axially from said bottom to a free distal axial edge and curving outward from near said opening to at least said periphery, each said blade having concave trailing face and a convex leading face and an end portion spaced radially outward from said opening to displace soil radially outward and enhance soil packing when rotated in the ground penetrating direction, said end portion of each said blade defining a trailing end of said blade extending beyond a periphery of said disk where the end portion is substantially normal to the radius of the disk and, said convex leading face of said blade extending parallel to an axis of said center through-opening and said trailing face sloping toward said disk, and where said free distal axial edge of each of said blades are substantially coplanar and lie in a plane oriented substantially perpendicular to a center axis of said disk.

2. The soil displacement device of claim 1, wherein the radius of curvature of each blade is non-uniform.

3. The soil displacement device of claim 2, wherein the radius of curvature of each blade is larger near the opening and near the disk periphery than its radius of curvature in an intermediate portion therebetween.

4. The soil displacement device of claim 1, wherein the thickness of each blade tapers toward its distal edge.

5. The soil displacement device of claim 4, wherein the bottom of the disk tapers toward its periphery.

6. The soil displacement device of claim 1, wherein the distal edges of the blades are substantially coplanar and substantially normal to said axis.

7. The soil displacement device of claim 1, further comprising an adapter ring extending axially from the top of the disk inboard of the disk periphery and defining an annular seat on the disk for centering a tubular casing.

8. The soil displacement device of claim 7, wherein the adapter ring has an outer face that tapers toward a distal end thereof.

9. The soil displacement device of claim 1, wherein, the distal edge of each of said blades is substantially perpendicular to said longitudinal axis.

10. The soil displacement device of claim 1, wherein the distal edge of each of said blades are substantially coplanar with each other.

11. A helical screw pile for penetrating the ground and forming a support, the screw pile comprising:

a shaft having a longitudinal axis and a bottom end;

at least one helical plate on said shaft near said bottom end, said helical plate having a leading, ground engaging edge and a trailing edge; and a soil displacement device on said shaft above said at least one helical plate, the soil displacement device including:

a disk having a periphery, a top, a bottom and a central opening through which the shaft extends; and at least two blades disposed substantially completely below the top of the disk, each blade projecting substantially axially from said bottom to a free distal axial edge to a free distal edge and curving outward from near said opening to at least said periphery, each said blade having a convex leading face with an end portion spaced radially from said opening and being curved to displace soil radially outward and enhance soil packing when said shaft is rotated in the ground penetrating direction, the blades extending beyond the disk periphery, and where an end portion of the leading face of each blade extending beyond the periphery of the disk is substantially normal to a radius of the disk, and where said free distal axial edge of each of said blades are substantially coplanar and lie in a plane oriented substantially perpendicular to a center axis of said disk.

12. The helical screw pile of claim 11, wherein the soil displacement device has an adapter ring extending axially from the top of the disk inboard of the disk periphery and defining an annular seat on the disk for supporting and centering a tubular casing surrounding the shaft.

13. The helical screw pile of claim 12, wherein the shaft includes a plurality of sequentially connected shaft segments including a lead shaft at the bottom and extension shafts thereabove, wherein the at least one helical plate is carried by the lead shaft and the soil displacement device is carried by either the lead shaft or one of the extension shafts, further comprising at least one extension displacement plate carried by the shaft above the soil displacement device, the extension displacement plate having oppositely facing annular seats for centering tubular casings surrounding the shaft.

14. The helical screw pile of claim 11, wherein the central opening and the shaft are substantially square, further comprising a substantially square insert in the central opening having a substantially square aperture sized to closely receive the shaft.

15. The soil displacement device of claim 11, wherein the distal edge of each of said blades are substantially perpendicular to said longitudinal axis.

16. A helical screw pile for penetrating the ground and forming a support, the screw pile comprising:

a shaft having a longitudinal axis and a bottom end;

at least one helical plate on said shaft near said bottom end, said helical plate having a leading, ground engaging edge and a trailing edge; and a soil displacement device on said shaft above said at least one helical plate, the soil displacement device including:

a disk having a periphery, a top, a bottom and a central opening through which the shaft extends; and at least two blades extending axially from said disk and disposed completely below the top of the disk, each blade having a free distal axial edge and curving radially outward from near said opening, each said blade having a convex leading ground engaging face being curved to displace soil radially outward and enhance soil packing when said shaft is rotated in the ground penetrating direction, each blade having an end portion with an axially extending end trailing edge oriented beyond the periphery of said disk, and where said end portion of the leading face of each blade extends beyond the periphery of the disk is substantially perpendicular to a radius of the disk, and where said free distal axial edge of each of said blades are substantially coplanar and lie in a plane oriented substantially perpendicular to a center axis of said disk; and an extension displacement plate on said shaft and spaced above said soil displacement device, said soil displacement plate having a central disk with a peripheral edge, first integral adapter ring extending axially from a first side of said central disk and second integral adapter ring extending axially form a second side of said central disk.

* * * * *